US010632769B2

(12) United States Patent
Takahashi et al.

(10) Patent No.: US 10,632,769 B2
(45) Date of Patent: Apr. 28, 2020

(54) PRINTER

(71) Applicants: CITIZEN WATCH CO., LTD., Nishitokyo-shi, Tokyo (JP); CITIZEN SYSTEMS JAPAN CO., LTD., Nishitokyo-shi, Tokyo (JP)

(72) Inventors: Akira Takahashi, Iida (JP); Takeshi Yamazaki, Iida (JP); Yuichi Taguchi, Iida (JP)

(73) Assignees: CITIZEN WATCH CO., LTD., Tokyo (JP); CITIZEN SYSTEMS JAPAN CO., LTD., Tokyo (JP)

( * ) Notice: Subject to any disclaimer, the term of this patent is extended or adjusted under 35 U.S.C. 154(b) by 0 days.

(21) Appl. No.: 16/147,340

(22) Filed: Sep. 28, 2018

(65) Prior Publication Data

US 2019/0030925 A1 Jan. 31, 2019

Related U.S. Application Data

(63) Continuation of application No. PCT/JP2017/007243, filed on Feb. 24, 2017.

(30) Foreign Application Priority Data

Mar. 30, 2016 (JP) ..... 2016-069261

(51) Int. Cl.
*B41J 3/60* (2006.01)
*B41J 11/70* (2006.01)
(Continued)

(52) U.S. Cl.
CPC ..... *B41J 11/70* (2013.01); *B41J 3/36* (2013.01); *B41J 3/60* (2013.01); *B41J 15/04* (2013.01); *B65H 16/02* (2013.01); *B65H 29/60* (2013.01)

(58) Field of Classification Search
CPC ..... B41J 11/70; B41J 3/36; B41J 11/00; B41J 3/60; B65H 16/02; B65H 29/60
See application file for complete search history.

(56) References Cited

U.S. PATENT DOCUMENTS 8,585,034 B1 11/2013 Mahoney et al.
8,599,229 B1 * 12/2013 Mindler ..... B41J 3/60 347/174
(Continued)

FOREIGN PATENT DOCUMENTS

CN 201511603 U 6/2010
CN 102024159 A 4/2011
(Continued)

OTHER PUBLICATIONS

International Preliminary Report on Patentability issued for corresponding International Patent Application No. PCT/JP2017/007243, dated Oct. 2, 2018, and notification of transmittal of the English translation dated Oct. 11, 2018.
(Continued)

*Primary Examiner* — Huan H Tran
(74) *Attorney, Agent, or Firm* — Myers Wolin, LLC

(57) ABSTRACT

A printer includes a recording medium holding unit that holds a long, wound strip-like recording medium to enable the recording medium to be pulled out from a front end thereof, a recording unit that pulls out the recording medium held by the recording medium holding unit to a side higher in a vertical direction than a position for pulling out from the recording medium holding unit and that executes a recording operation for the pulled-out recording medium, and a second cutter mechanism disposed under the recording medium holding unit and that cuts the recording medium for which the recording operation is executed by the recording unit at the back end thereof separated from the front end by a predetermined length. A drawing position of the recording
(Continued)

medium into an inversion path is arranged to be lower than the recording medium holding unit and the recording unit in the vertical direction.

4 Claims, 12 Drawing Sheets

(51) Int. Cl.

| | |
|---|---|
| ***B41J 15/04*** | (2006.01) |
| ***B65H 16/02*** | (2006.01) |
| ***B41J 3/36*** | (2006.01) |
| ***B65H 29/60*** | (2006.01) |

(56) References Cited

U.S. PATENT DOCUMENTS

| | | | | |
|---|---|---|---|---|
| 8,599,230 | B1 * | 12/2013 | Mindler | B41J 3/60 347/174 |
| 8,885,003 | B2 * | 11/2014 | Mindler | B41J 2/325 347/176 |
| 8,994,767 | B1 | 3/2015 | Liao | |
| 2012/0168495 | A1 | 7/2012 | Zheng et al. | |
| 2013/0342626 | A1 | 12/2013 | Mindler et al. | |
| 2014/0055548 | A1 | 2/2014 | Mindler et al. | |
| 2015/0231899 | A1 | 8/2015 | Yamamoto et al. | |
| 2015/0246555 | A1 | 9/2015 | Kamitani et al. | |

FOREIGN PATENT DOCUMENTS

| | | | |
|---|---|---|---|
| CN | 104395090 | A | 3/2015 |
| CN | 104786667 | A | 7/2015 |
| CN | 105216457 | A | 1/2016 |
| JP | 2011110789 | A | 6/2011 |
| JP | 5509791 | B2 | 6/2014 |
| JP | 2014129170 | A | 7/2014 |
| JP | 2015136796 | A | 7/2015 |
| JP | 2015528757 | A | 10/2015 |

OTHER PUBLICATIONS

The extended European search report with supplementary European search report and European search opinion dated Oct. 24, 2019.

First Office Action issued by the China National Intellectual Property Administration for corresponding Chinese Patent Application No. 201780016717.7 dated Nov. 12, 2019, with an English translation.

Notice of Reasons for Refusal issued by the Japan Patent Office for corresponding Japanese Patent Application No. 2016-180409, dated Dec. 3, 2019, with an English translation.

Notice of Reasons for Refusal issued by the Japan Patent Office for corresponding Japanese Patent Application No. 2016-069261, dated Jul. 30, 2019, with an English translation.

Notice of Reasons for Refusal issued by the Japan Patent Office for corresponding Japanese Patent Application No. 2016-069261, dated Oct. 8, 2019, with an English translation.

* cited by examiner

PRINTER

CROSS-REFERENCE TO RELATED APPLICATIONS

This is a continuation under 35 U.S.C. § 120 of International Application PCT/JP2017/007243, filed Feb. 24, 2017, which claims priority to JP Application 2016-069261, filed Mar. 30, 2016, the contents of each of which are incorporated by reference herein.

TECHNICAL FIELD

The present invention relates to a printer capable of executing recording to both sides of a recording medium.

BACKGROUND ART

Conventionally, a printer has been present that executes a recording operation for both sides of a recording medium. Such types of printers include a printer that cuts a long strip-like recording medium at a predetermined length for use therein. To realize recording to both sides of the recording medium by a single recording unit, the front side and the back side of the recording medium need to be inverted from each other relative to a position for recording by the recording unit such as a printing head after a recording operation is executed for the front side and before another recording operation is executed for the back side. When the long strip-like recording medium is used, to invert the front side and the back side thereof from each other, the long strip-like recording medium needs to be cut prior to the inversion.

On the other hand, to ensure the precision of the position for the recording, the recording medium needs to be firmly gripped to avoid any displacement of the position of the recording medium during the recording operation. So that gripping marks do not remain on the recording medium after the recording operation, a margin portion outside the print range needs to be gripped during the recording operation and the margin portion needs to be cut off after the recording operation is executed. A printer has therefore traditionally been present that includes two cutters that are a cutter that cuts for the inversion and another cutter that cuts off the margin portion after the double-side recording is completed.

For example, a printer has been traditionally present that includes, at a branching position of three conveyance paths branching into three directions toward a holding unit that holds a long trip-like recording medium wound thereon in a roll, a recording unit that executes a recording operation, and an inversion path that is used to invert the recording medium, a flow diverter that is selectively positioned at a first position to connect the holding unit and the recording unit to each other and the inversion path and the recording unit to each other, and at a second position to connect the holding unit and the inversion path to each other (for example, refer to Patent Document 1 below).

In the printer described in Patent Document 1, after executing printing for the front side of the recording medium conveyed from the holding unit to the recording unit by positioning the flow diverter at the first position, the recording medium is pulled back to the holding unit, the flow diverter is positioned at the second position, and the recording medium to which the printing is executed on the front side thereof is conveyed to the inversion path. When the recording medium is conveyed to the inversion path, the long strip-like recording medium is cut at a predetermined length by the first cutter disposed near the holding unit.

Printing is executed for the back side of the recording medium conveyed from the inversion path to the recording unit by positioning the flow diverter at the first position, and the margin of the recording medium to which the printing is executed on both sides thereof is thereafter cut off by the second cutter.

For example, a printer has been traditionally present according to which one of the holding unit and the recording unit is inverted relative to the front side and the back side of a recording medium, the front side and the back side of the recording medium is inverted from each other relative to the position for the recording by the recording unit, and a recording operation is thereby executed for each of both sides of the recording medium (for example, refer to Patent Document 2 below).

For example, a printer has been traditionally present according to which a long strip-like recording medium is cut at a predetermined length by the first cutter after printing is executed for the front side by conveying the long strip-like recording medium is conveyed to the recording unit, the front side and the back side of the recording medium is inverted relative to the position for the recording by the recording unit by transposing the front end and the back end with each other by bowing the cut recording medium, printing is executed for the back side of the inverted recording medium, and the recording medium for which the printing is executed on both sides thereof is thereafter cut by the second cutter and discharged (for example, refer to Patent Document 3 below).

For example, a printer has been traditionally present according to which a long strip-like recording medium is conveyed from a discharge outlet side to a gap between a thermal head and a platen roller that are arranged to face each other sandwiching therebetween a conveyance path spanning from a holding unit holding the long strip-like recording medium wound thereon in a roll to a discharge outlet, front-side printing is executed, the recording medium for which the front-side printing is executed is pulled back to the holding unit, the recording medium is thereafter conveyed from the holding unit side to execute back-side printing, and the recording medium for which the printing is executed on both sides thereof is cut by a cutter and discharged (for example, refer to Patent Document 4 below).

Patent Document 1: Published Japanese-Translation of PCT Application, Publication No. 2015-528757

Patent Document 2: Japanese Patent No. 5509791

Patent Document 3: Japanese Laid-Open Patent Publication No. 2011-110789

Patent Document 4: Japanese Laid-Open Patent Publication No. 2015-136796

DISCLOSURE OF INVENTION

Problem to be Solved by the Invention

With the traditional technique described in Patent Document 1, jamming however tends to occur because a structure around the branching position is complicated, and a problem therefore arises in that work to solve jamming is difficult to execute. With the traditional technique described in Patent Document 2, one of the holding unit and the recording unit is inverted relative to the front side and the back side of the recording medium and a problem therefore arises in that the size of the printer increases.

With the traditional technique described in Patent Document 3, the recording medium passes through the cutter mechanism during the recording operation, whereby scuffs are caused on the recording face, and the recording medium is hooked by the cutter mechanism. A problem therefore arises in that jamming tends to occur. With the traditional technique described in Patent Document 4, the conveyance path meanders because the recording medium is conveyed from different directions into the gap between the thermal head and the platen roller, and a problem therefore arises in that the size of the printer increases. With the traditional technique described in Patent Document 4, in addition to a tendency for jamming due to the meandering of the conveyance path, a problem also arises in that recovery is difficult when jamming occurs.

To solve the above problems related to the traditional techniques, one object of the present invention is to provide a printer for which reductions in size can be facilitated.

Means for Solving Problem

To solve the problems above and achieve an object, a printer according to the present invention is characterized in that the printer includes a recording medium holding unit that holds a long, wound, strip-like recording medium so as to enable the recording medium to be pulled out starting with a front end on an outer circumference side thereof; a recording unit that pulls out the recording medium held by the recording medium holding unit to a position higher in a vertical direction than a position for pulling out from the recording medium holding unit, the recording unit performing a recording operation for the recording medium that is pulled out; a cutting unit that is disposed beneath the recording medium holding unit in the vertical direction, the cutting unit cutting the recording medium at a back end of the recording medium for which the recording operation is executed by the recording unit, the back end being separated from the front end by a predetermined length; a first switching unit that includes a first switching member selectively positioned at a front side recording position connecting a position for recording by the recording unit and the position for pulling out, and at an inversion position connecting a position for cutting by the cutting unit and the position for pulling out, the first switching unit positioning the first switching member at the front side recording position or the inversion position; an inverting unit that includes an inversion path that draws in from the front end, the recording medium cut off by the cutting unit, the inverting unit discharging the recording medium drawn into the inversion path to an exterior of the inversion path starting with the back end thereof; and a second switching unit that includes a second switching member selectively positioned at an inversion start position connecting a drawing position to draw the recording medium into the inversion path and the position for the cutting, and at the back side recording position connecting the drawing position and the recording position, the second switching unit positioning the second switching member at the inversion start position or the back side recording position. The printer is further characterized in that drawing position is arranged to be lower than the recording medium holding unit and the recording unit in the vertical direction.

The printer according to the present invention is further characterized in that in the invention above, the inversion path is arranged on a side opposite the recording medium holding unit, sandwiching the recording unit therebetween in a horizontal direction for the recording medium for which the recording operation is executed by the recording unit.

The printer according to the present invention is further characterized in that in the invention above, the inversion path is arranged to surround the recording unit from a side opposite the recording medium holding unit.

The printer according to the present invention is further characterized in that in the invention above, the second switching unit includes an urging unit that urges the second switching member to position the second switching member at the back side recording position, and the urging unit positions the second switching unit at the inversion start position when the second switching unit is urged by the recording medium conveyed to the drawing position.

EFFECT OF THE INVENTION

According to the printer of the present invention, an effect is achieved in size reductions of the printer can be facilitated.

BEST MODE(S) FOR CARRYING OUT THE INVENTION

Preferred embodiments of a printer according the present invention will be described in detail with reference to the accompanying drawings.

(Outer Appearance of Printer)

Figure 1:
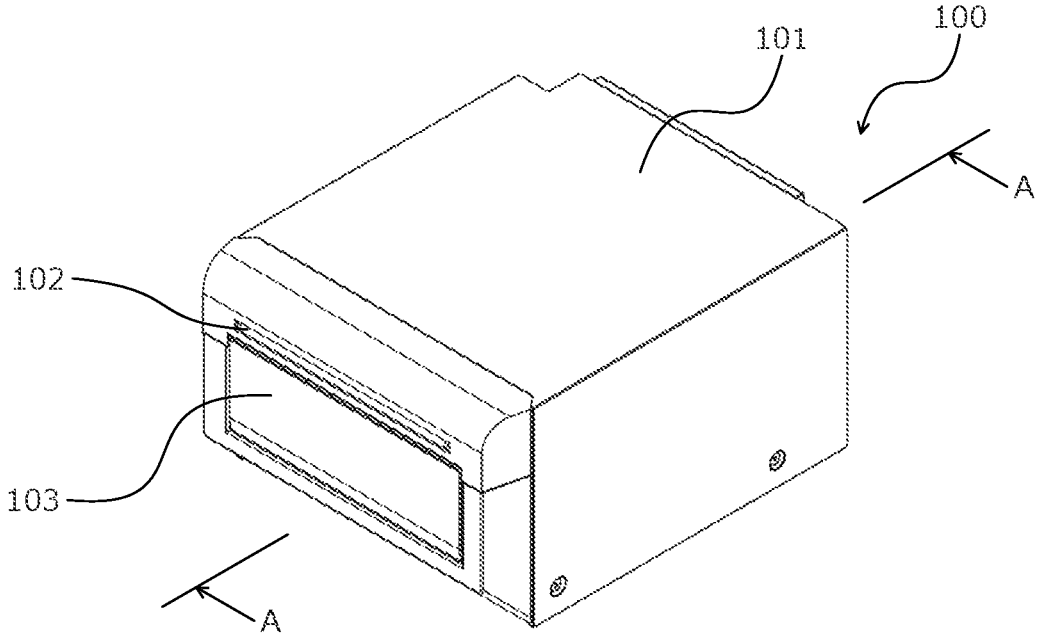
FIG. 1 is an explanatory diagram of an outer appearance of a printer of an embodiment according to the present invention.

The outer appearance of the printer of an embodiment according to the present invention will be described. FIG. 1 is an explanatory diagram of the outer appearance of the printer of the embodiment according to the present invention. In FIG. 1, the printer 100 of the embodiment according to the present invention includes a substantially box-shaped housing 101. A discharge outlet 102 that discharges a recording medium for which a recording operation is executed by the printer 100 is disposed at a front of the housing 101.

A cutting waste collecting box 103 is disposed at the front of the housing 101, beneath the discharge outlet 102. The cutting waste collecting box 103 is detachably attached to the housing 101. The cutting waste collecting box 103 accommodates cut pieces (cutting waste) produced during the recording operation executed for the recording medium by the printer 100.

A printer main body is accommodated in the housing 101 so to enable removal from the housing 101. The printer main body can be pulled out of the housing 101 from the front side of the housing 101. As to the printer main body, an upper portion of the cutting waste collecting box 103 is supported by an axis, enabling rotation in a direction away from the cutting waste collecting box 103 relative to the printer main body. In the printer main body, a first cutter mechanism described later (see reference numeral "204" in FIG. 2) is disposed at a portion above the cutting waste collecting box 103. In the printer 100, the printer main body is pulled out from the housing 101, the cutting waste collecting box 103 is removed, the upper portion of the cutting waste collecting box 103 is rotated relative to the printer main body, and the inside of the housing 101 can thereby be opened.

(Internal configuration of Printer 100)

Figure 2:
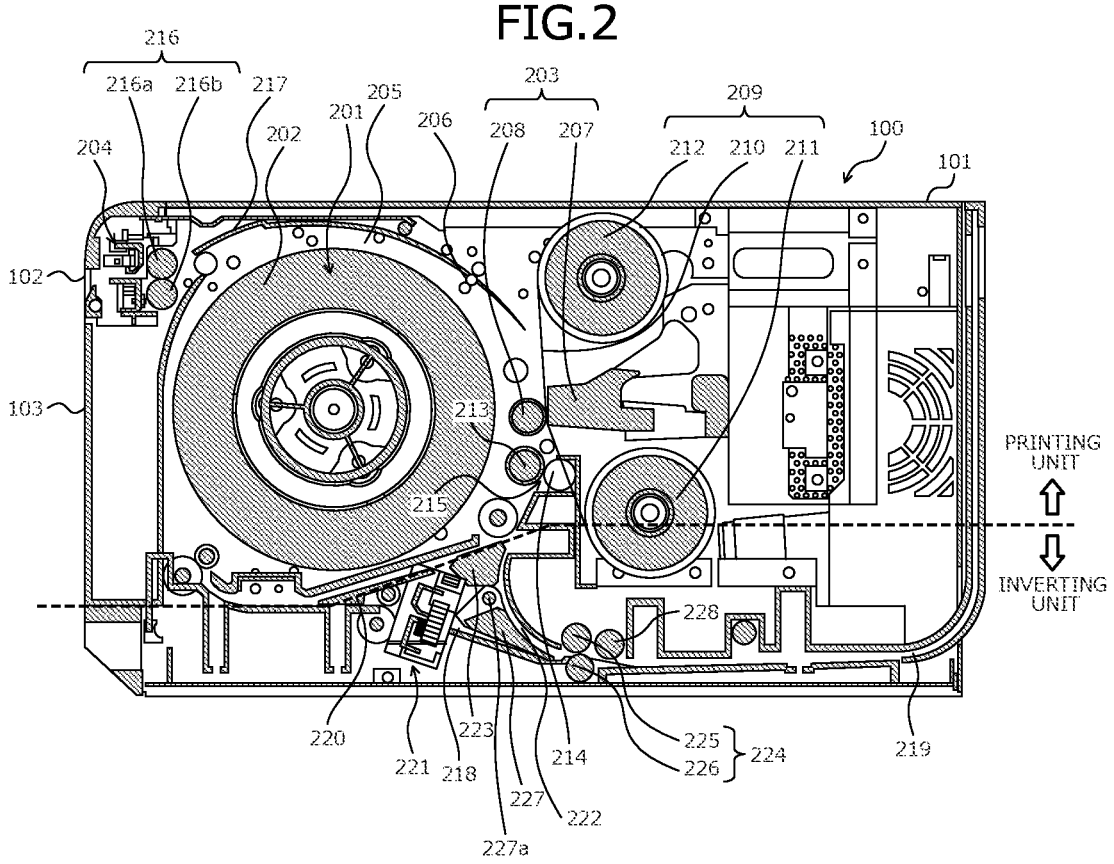
FIG. 2 is an A-A cross-sectional diagram of FIG. 1.

An internal configuration of the printer 100 of the embodiment according to the present invention will be described. FIG. 2 is an A-A cross-sectional diagram of FIG. 1. In FIG. 2, the printer 100 includes, in the housing 101, a recording medium holding unit 201 that holds a recording medium 202 to be recorded on. In this embodiment, a recording medium holding unit according to the present invention can be realized by the recording medium holding unit 201. The recording medium holding unit 201 holds the recording medium 202 that is wound thereon in a roll. The recording medium holding unit 201 holds an outer circumferential portion of the long strip-like recording medium 202 that is wound thereon in a roll, from beneath of the recording medium.

The recording medium holding unit 201 is opened to the exterior by opening the inner side of the printer main body by rotating relative to the printer main body, the upper portion of the cutting waste collecting box 103 of the printer main body that has been pulled out from the housing 101. The recording medium 202 wound in a roll can thereby be replaced or replenished with respect to the recording medium holding unit 201.

The recording medium holding unit 201 holds, in a rotatable manner, the recording medium 202 that is wound in a roll in the recording medium holding unit 201. The recording medium holding unit 201 holds, in a rotatable manner, a shaft of the recording medium 202 wound in a roll and thereby holds the recording medium in a rotatable manner.

The recording medium holding unit 201 is coupled with a recording medium conveyance motor (see FIG. 3) through a predetermined gear train, and rotates the shaft of the recording medium using a driving force of the recording medium conveyance motor transmitted through the predetermined gear train. The recording medium holding unit 201 rotates selectively in a direction to pull out (unreel) the recording medium from the recording medium holding unit 201 and a direction to draw the recording medium into the recording medium holding unit 201.

The recording medium includes a recording layer. The recording layer included in the recording medium is disposed on the surface of a base material formed by a paper sheet or the like. The recording layer includes a heat-insulating layer that is applied or bonded to the base material and a receiving layer that is stacked on the heat-insulating layer. In the recording medium, the recording layer is disposed on both sides of the base material. For the printer 100, a recording medium is usable that has a recording layer disposed only on one side of the base material.

In the housing 101, a first conveyance path 205 is disposed, spanning from a pulling-out position of the recording medium in the recording medium holding unit 201 to the discharge outlet 102, sequentially through a recording unit 203 and the first cutter mechanism 204. The pulling-out position of the recording medium in the recording medium holding unit 201 is disposed lower in the vertical direction than is the position for the recording by the recording unit 203. A height of the pulling-out position is lower than a height of the position for the recording. In the first conveyance path 205, a conveyance roller 206 that conveys the recording medium held by the recording medium holding unit 201 to the recording unit 203 may be disposed between the recording medium holding unit 201 and the recording unit 203.

The recording unit 203 pulls out the recording medium held by the recording medium holding unit 201 to a side higher in the vertical direction than is the pulling-out position from the recording medium holding unit 201 and executes the recording operation for the pulled out recording medium. In this embodiment, a recording unit according to the present invention can be realized by the recording unit 203.

The recording unit 203 includes a thermal head 207 and a platen 208. The thermal head 207 and the platen 208 are disposed to face each other with the first conveyance path 205 therebetween. The thermal head 207 is disposed to be movable to a position to be in contact with the platen 208 and a position to become separated from the platen 208.

The thermal head 207 includes plural heat-generating elements (heat-generating resisters) arranged in a line along a width direction of the recording medium, and a driver IC that drives the heat-generating elements. The driver IC is driven and controlled by a microcomputer included in the printer 100. The driver IC is driven and controlled by the microcomputer to selectively energize electrode wires connected from a power source not depicted to the heat-generating elements in the thermal head 207, and thereby causes the heat-generating elements corresponding to the energized electrode wires to generate heat.

The platen 208 has a cylinder-like shape and a direction along a shaft center thereof is the width direction of the recording medium; the platen 208 is disposed to be rotatable around the shaft center. The platen 208 is disposed to be rotatable in a counterclockwise direction (the forward direction) in FIG. 2 and a clockwise direction (the backward direction) in FIG. 2. The platen 208 receives pressure applied to the recording medium by the thermal head 207 that faces the platen 208 sandwiching the recording medium therebetween.

The recording unit 203 also includes a ribbon unit 209. The ribbon unit 209 includes a pair of ribbon cores 211 and 212 that hold an ink ribbon 210. The pair of ribbon cores 211 and 212 hold the ink ribbon 210 so that the ink ribbon 210 is stretched between the thermal head 207 and the platen 208. The pair of ribbon cores 211 and 212 hold the ink ribbon 210 in a state where an ink layer in the ink ribbon 210 faces the platen 208 between the thermal head 207 and the platen 208.

The pair of ribbon cores 211 and 212 are constituted by the take-up ribbon core 211 and the supply ribbon core 212. The take-up ribbon core 211 is disposed to be rotatable in the clockwise direction in FIG. 2, and rotates to thereby reel up the ink ribbon 210 held by the supply ribbon core 212, starting with one end of the ink ribbon 210.

The supply ribbon core 212 holds the long strip-like ink ribbon 210 wound thereon, the supply ribbon core 212 holding the ink ribbon 210 so that the ink ribbon can be unreeled from an outer circumference side of the ink ribbon 210. The supply ribbon core 212 rotates in the clockwise direction in FIG. 2 associated with the winding up of the ink ribbon 210 due to the rotation of the take-up ribbon core 211, and unreels the ink ribbon 210 from the outer circumference side thereof.

The ink ribbon 210 held by the ribbon unit 209 includes a long strip-like base material and ink layers disposed on one face side of the base material. For example, the ink ribbon 210 includes ink layers for colors including yellow (Y), magenta (M), and cyan (C). Each of the ink layers is formed by a sublimation dye ink (an ink including a sublimation dye (a sublimation pigment), that is, a sublimation ink).

In the ink ribbon 210, the ink layers for plural colors are periodically arranged along the length direction of the base material for each of the colors. For example, the ink layers of yellow (Y), magenta (M), and cyan (C) are periodically arranged in order of "the ink layer for yellow (Y)→the ink layer for magenta (M)→the ink layer for cyan (C)→ . . . " along the length direction of the base material.

The ink ribbon 210 includes an overcoat layer. The overcoat layer is, together with the ink layers, periodically arranged along the length direction of the base material. For example, in the ink ribbon 210, the layers are periodically arranged in order of "the ink layer for yellow (Y)→the ink layer for magenta (M)→the ink layer for cyan (C)→the overcoat layer→the ink layer for yellow (Y)→ . . . " along the length direction of the base material.

The printer 100 executes a recording operation of a sublimation transfer scheme. The recording operation according to the sublimation transfer scheme is executed by causing the heat-generating elements to selectively generate heat by selectively energizing the heat-generating elements in the thermal head 207, transmitting the heat generated by the heat-generating elements to the ink ribbon 210, and transferring, by sublimation, the sublimation dye ink included in the ink layer included in the ink ribbon 210 to the receiving layer in the recording medium, whereby the recording layer in the recording medium is recorded on.

The printer 100 can adjust the density of the ink to be transferred to the recording medium for each dot that is to be recorded by executing the recording operation according to the sublimation transfer scheme. The printer 100, which executes the recording operation according to the sublimation transfer scheme, is therefore excellent in gradation expression. Because the printer 100 executes the recording operation according to the sublimation transfer scheme and can present excellent gradation expression, image quality that is sufficiently usable for printing a photograph can be obtained. The printer 100, which executes the recording operation according to the sublimation transfer scheme is called, for example, "dye-sublimation printer".

In the recording operation, the printer 100 applies a lamination process to the surface (the recording face) of the recording medium for which the recording operation is executed, by disposing the overcoat layer to cover the recording face. As a result, degradation of the water-resistant performance and weathering-resistant performance of the sublimation dye ink in the recorded article can be suppressed and the water-resistant performance and the weathering-resistant performance of the recorded article can be enhanced. When the recording operation is executed for each of the sides of the recording medium, the overcoat layer is disposed in each recording operation for each one side.

A gripping roller 213 and a pinch roller 214 are disposed in the housing 101. The gripping roller 213 and the pinch roller 214 are arranged to face each other sandwiching the first conveyance path 205 therebetween. Along the first conveyance path 205, the gripping roller 213 and the pinch roller 214 are disposed closer toward the recording medium holding unit 201 than the recording unit 203.

The gripping roller 213 is disposed on the back side of the recording face of the recording medium during the recording operation. The pinch roller 214 is urged in the direction to abut the gripping roller 213 that is disposed facing the pinch roller 214. The recording medium conveyed in the first conveyance path 205 can thereby be held sandwiched in a nipping portion 215 where the gripping roller 213 and the pinch roller 214 abut each other.

The gripping roller 213 includes a protrusion (not depicted) that protrudes in an outer circumference direction, thereby enabling slipping to be prevented between the gripping roller 213 and the recording medium. The force (the gripping force) for the gripping roller 213 and the pinch roller 214 to be able to hold and sandwich the recording medium therebetween and convey the recording medium is secured to be larger sufficiently than the loads received by the recording medium from the recording unit 203 and the first conveyance path 205. Slipping can thereby be reliably prevented between the gripping roller 213 and the recording medium.

The gripping roller 213 is coupled with the recording medium conveyance motor (see FIG. 3) through a predetermined gear train. The gripping roller 213 can thereby be rotated in a state where the recording medium is held sandwiched between the gripping roller 213 and the pinch roller 214. The gripping roller 213 is rotated in the state where the recording medium is held being sandwiched between the gripping roller 213 and the pinch roller 214, and the position of the recording medium can thereby be controlled relative to the position for the recording by the recording unit 203.

In the housing 101, near the gripping roller 213, a recording medium detection sensor (see FIG. 3) is disposed that detects the front end position of the recording medium pulled out from the recording medium holding unit 201 to the first conveyance path 205. For example, the recording medium detection sensor can be realized by an optical sensor that includes a light-emitting element and a light-receiving element disposed to face each other sandwiching the first conveyance path 205 therebetween and whose output varies corresponding to variation of the amount of the light received by the light-receiving element.

The amount of the light received by the light-receiving element is varied as a consequence of the light emitted by the light-emitting element being blocked when the recording medium conveyed in the first conveyance path 205 passes between the light-emitting element and the light-receiving element. The printer 100 can detect the front end position of the recording medium pulled out from the recording medium holding unit 201 to the first conveyance path 205 based on the output value of the recording medium detection sensor, the output value varying corresponding to the variation of the amount of the light received by the light-receiving element. In this manner, the recording position for each of the colors relative to the recording medium can be aligned with high precision by disposing the recording medium detection sensor near the gripping roller 213 and a high quality recorded article can be obtained.

The first cutter mechanism 204 is disposed near the discharge outlet 102. The first cutter mechanism 204 includes a fixed blade whose position is fixed and a movable blade disposed to be movable (able to reciprocate) in the width direction of the recording medium along the fixed blade. The movable blade is in contact with the fixed blade and is disposed at a position to sever the first conveyance path 205. The movable blade has a circular plate-like shape in which the blade is included in the outer circumferential portion thereof, the moveable blade being disposed to be movable (able to reciprocate) in the width direction of the recording medium along the fixed blade. The movable blade is disposed at a position such that the passage of the recording medium is not obstructed when no operation is executed such as when the movable blade stands by to cut the recording medium.

The first cutter mechanism 204 includes a driving source such as a movable blade driving motor, a power transmission mechanism (not depicted) that transmits the driving force generated by the movable blade driving motor to the movable blade, and the like. The first cutter mechanism 204 cuts the recording medium by moving the movable blade along the width direction of the recording medium using the driving force generated by the movable blade driving motor in a state where a position for cutting (that is, the position to be cut at) of the recording medium is conveyed to the position (i.e., the position for the cutting by the first cutter mechanism 204) at which the movable blade moves (reciprocates) crossing the first conveyance path 205 in the first conveyance path 205.

In the first conveyance path 205, a gripping roller pair 216 is disposed near the first cutter mechanism 204. The gripping roller pair 216 includes a pair of rollers 216*a* and 216*b* disposed to face each other sandwiching the first conveyance path 205 therebetween. One roller 216*a* is coupled with the recording medium conveyance motor (see FIG. 3) through a predetermined gear train. The one roller 216*a* is rotated by transmitting thereto the driving force of the motor coupled therewith through the predetermined gear train. The other roller 216*b* is rotated by the friction of the one roller 216*a* or that of the recording medium between the one roller 216*a* and the other roller 216*b*.

Along the first conveyance path 205, the gripping roller pair 216 is disposed closer to the recording unit 203 than to the first cutter mechanism 204. Near the gripping roller pair 216, a front end detecting sensor (see FIG. 3) is disposed that detects the front end position of the recording medium conveyed to the first cutter mechanism 204. The front end detecting sensor can be realized by, for example, an optical sensor similar to the recording medium detection sensor.

The cutting waste collecting box 103 is disposed on the lower side, in the vertical direction, of the first cutter mechanism 204 in the housing 101. The cutting waste collecting box 103 can be realized by a member that has a box-shape with a bottom and that includes, at an upper side, an opening to receive cut pieces (cutting waste) produced in the recording operation executed for the recording medium.

On the first conveyance path 205, a guiding member 217 is disposed that guides the position of the recording medium such that the recording medium to be recorded on is conveyed along the first conveyance path 205. The guiding member 217 guides the position of the recording medium such that the recording medium pulled out from the recording medium holding unit 201 passes by the recording unit 203 and is thereafter conveyed to the first cutter mechanism 204. The guiding member 207 has a conveyance assisting member disposed thereon to smoothly convey the recording medium in the first conveyance path 205.

The conveyance assisting member includes, for example, a receiving portion that is disposed on the guiding member 217 and that has an arc-like shape, and rolling elements such as spheres or rollers fitted in the receiving portion. The first conveyance path 205 has a conveyance roller 206 pair disposed thereon. Of the conveyance roller 206 pair, at least one conveyance roller 206 is coupled with the recording medium conveyance motor through a predetermined gear train (neither is depicted).

One end of a second conveyance path 218 is connected to the first conveyance path 205 between the pulling-out position of the recording medium in the recording medium holding unit 201 and the position for the recording by the recording unit 203. The other end of the second conveyance path 218 is connected to an inversion path 219. The second conveyance path 218 is disposed lower in the vertical direction than the pulling-out position of the recording medium in the recording medium holding unit 201 and the recording unit 203.

A first flap 220 is disposed at a connection position (branching position) of the first conveyance path 205 and the second conveyance path 218. The first flap 220 is coupled with the recording medium conveyance motor through a predetermined gear train (see FIG. 3) and is selectively positioned by the driving force of the recording medium conveyance motor transmitted through the predetermined gear train, at a front side recording position connecting the pulling-out position of the recording medium in the recording medium holding unit 201 and the position for the recording by the recording unit 203 to each other, and at an inversion position connecting the pulling-out position and the inversion path 219 to each other. In this embodiment, a first switching member according to the present invention can be realized by the first flap 220.

A second cutter mechanism 221 is disposed on the second conveyance path 218. In this embodiment, a cutting unit according to the present invention can be realized by the second cutter mechanism 221. The second cutter mechanism 221 includes a fixed blade whose position is fixed and a movable blade disposed to be movable (able to reciprocate) in the width direction of the recording medium along the fixed blade, and has the same configuration as that of the first cutter mechanism 204.

Near the second cutter mechanism 221, a front end detecting sensor (see FIG. 3) is disposed that detects the front end position of the recording medium conveyed to the second cutter mechanism 221. The front end detecting sensor can be realized by, for example, an optical sensor similar to the recording medium detection sensor.

The inversion path 219 has one end that is connected to the other end of the second conveyance path 218, and is disposed to pass through a vicinity of a lower face in the housing 101 and extend on the upper side along the wall face on the side opposite to the recording medium holding unit 201 sandwiching the recording unit 203 therebetween. The other end of the inversion path 218 is disposed at a position close to the wall face on the side opposite to the recording medium holding unit 201 sandwiching the recording unit 203 therebetween.

One end of a third conveyance path 222 is connected to the connection position (a drawing position) of the inversion path 219 and the second conveyance path 218. At the drawing position, the inversion path 219, the second conveyance path 218, and the third conveyance path 222 are connected to each other. The other end of the third conveyance path 222 is connected to the nipping portion 215 of the gripping roller 213 and the pinch roller 214.

A part of the third conveyance path 222, at the other end thereof, overlaps a portion of the first conveyance path 205. A second flap 223 is disposed at the branching position of the first conveyance path 205 and the third conveyance path 222. The second flap 223 is selectively positioned at a position to open the first conveyance path 205 and close the third conveyance path 222, and at a position to close the first conveyance path 205 and open the third conveyance path 222.

An inversion roller pair 224 is disposed at the drawing position. The one inversion roller 225 of the pair of inversion rollers 225 and 226 constituting the inversion roller pair 224 is coupled with the recording medium conveyance motor (see FIG. 3) through a predetermined gear train. One inversion roller 225 is rotated by transmitting thereto the driving force of the recording medium conveyance motor coupled therewith through the predetermined gear train.

The one inversion roller 225 is disposed to be rotatable in the counterclockwise direction (a drawing direction) in FIG. 2 and the clockwise direction (an inversion direction) in FIG. 2 corresponding to the rotation direction of the recording medium conveyance motor coupled therewith through the predetermined gear train. In this embodiment, an inverting unit according to the present invention can be realized by the inversion path 219 and the inversion roller pair 224.

A third flap 227 is disposed at the drawing position. The third flap 227 is disposed to be able to swing centering a fulcrum 227*a* disposed to be higher in the vertical direction than the drawing position. Around the fulcrum 227*a*, the third flap 227 swings between an inversion start position to connect the position for the cutting by the second cutter mechanism 221 and the drawing position to each other, and a back side recording position to connect the drawing position and the position for the recording by the recording unit 203 to each other.

The third flap 227 in the normal state thereof is positioned by an urging force of an urging member at a position to connect the position for the recording by the recording unit 203 and the inversion path 219 to each other. In this embodiment, a second switching member according to the present invention can be realized by the third flap 227.

The printer 100 may include an urging unit that urges the third flap 227 to position the third flap 227 at the back side recording position. The urging unit can be realized by, for example, a torsion spring that is disposed on a shaft forming the fulcrum 227*a* to be the rotation center of the third flap 227. Otherwise, the urging unit may be realized by, for example, a compression spring or a tension spring that urges the end portion on the side of the drawing position of the third flap 227 to the side of the back side recording position. In this case, the urging unit causes the third flap 227 to be positioned at the inversion start position when the urging unit is urged by the recording medium conveyed to the drawing position.

A correction roller 228 that corrects the winding curl of the recording medium is disposed near the one inversion roller 225. The correction roller 228 includes, for example, a heat-generating body on the surface thereof. The correction roller 228 causes the heat-generating body on the surface thereof to generate heat by a supply of electricity from a power source not depicted, applies the generated heat to the recording medium conveyed from the inversion path to the position for the recording by the recording unit 203, and thereby corrects the winding curl of the recording medium.

(Hardware Configuration of Printer 100)

Figure 3:
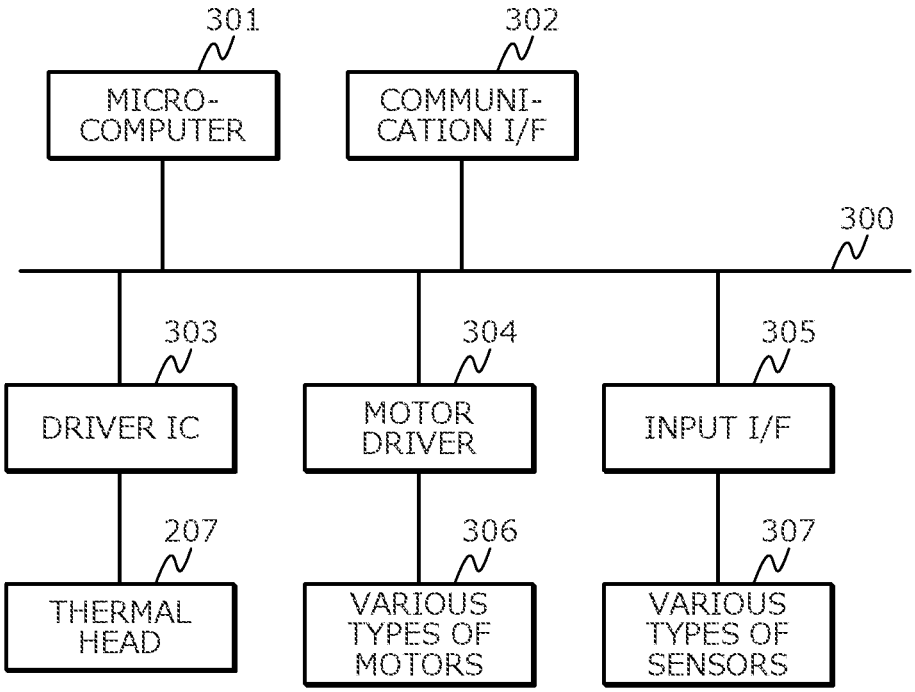
FIG. 3 is an explanatory diagram of a hardware configuration of a printer 100 of the embodiment according to the present invention.

A hardware configuration of the printer 100 of the embodiment according to the present invention will be described. FIG. 3 is an explanatory diagram of the hardware configuration of the printer 100 of the embodiment according to the present invention. In FIG. 3, the printer 100 includes a microcomputer 301, a communication interface (I/F) 302, a driver IC 303, a motor driver 304, and an input I/F 305. The components of the microcomputer 301, the communication I/F 302, the driver IC 303, the motor driver 304, and the input I/F 305 are connected to each other by a bus 300.

The microcomputer 301 drives and controls the components included in the printer 100. The microcomputer 301 can be realized by, for example, a circuit board that has various types of circuits mounted thereon such as a CPU, a memory such as a ROM or a RAM, input and output circuits, and a timer circuit.

The microcomputer 301 drives and controls the components included in the printer 100 by executing on the CPU, various types of control programs stored in the memory, based on various types of data stored in the memory included in the microcomputer 301 and various types of data received from an external apparatus not depicted through the communication I/F 302. In the microcomputer 301, the CPU uses, for example, the RAM as the work area for expanding image data necessary for the printing based on recording instruction information.

The communication I/F 302 is connected to an external apparatus not depicted. The communication I/F 302 may be connected directly to an external apparatus or may be connected thereto through a network. The communication I/F 302 supervises an internal interface with the external apparatus and controls the input and the output of data for the printer 100.

For example, the external apparatus produces a recording instruction for the printer 100 and outputs the produced recording instruction to the printer 100. The external apparatus can be realized by, for example, a personal computer installed in a DPE stand that provides a service of outputting by printing, an image shot by a digital camera.

The recording instruction includes, for example, information on an image and the like to be recorded on the recording medium, and a command instructing the recording of this information. For example, the external apparatus outputs, as a recording instruction, a single-side recording instruction instructing a recording operation for the one side of the recording medium (single-side recording) or a double-side recording instruction instructing the recording operations for both sides of the recording medium (double-side recording).

The driver IC 303 is driven and controlled by the microcomputer 301. The driver IC 303 is driven and controlled by the microcomputer 301 and thereby selectively energizes the electrode wires corresponding to the plural heat-generating elements included in the thermal head 207 in the recording unit 203. The heat-generating elements can thereby be selectively caused to generate heat. The heat generated by the heat-generating elements of the thermal head 207 is transmitted to the recording layer of the recording medium through the ink ribbon 210, the sublimation dye ink disposed in the ink ribbon 210 is thereby transferred, by sublimation, to the recording medium, enabling the recording operation to be executed for the recording medium.

The motor driver 304 is driven and controlled by the microcomputer 301. The motor driver 304 is connected to various types of motors 306 such as a motor that is coupled with the gripping roller 213, the conveyance roller 206 pair, the inversion roller 224, and the like, the movable blade driving motor in the first cutter mechanism 204, and the motor coupled with the first flap 220 and the third flap 227. The motor driver 304 drives and controls the various types of motors 306 connected to the motor driver 304, based on control signals from the microcomputer 301.

In this embodiment, a first switching unit according to the present invention can be realized by the motor coupled with the first flap 220, the motor driver 304 that drives and controls this motor, the microcomputer 301 that drives and controls the motor driver 304, and the like. In this embodiment, a second switching unit according to the present invention can be realized by the motor coupled with the third flap 227, the motor driver 304 that drives and controls this motor, the microcomputer 301 that drives and controls the motor driver 304, and the like.

The input I/F 305 is connected to various types of sensors 307 included in the printer 100 such as the recording medium detection sensor. The various types of sensors 307 may be connected to the input I/F 305 using a universal serial bus (USB). The input I/F 305 outputs signals that correspond to the output values from the various types of sensors 307 to the microcomputer 301. The microcomputer 301 drives and controls the components included in the printer 100 based on the signals output from the input I/F 305.

(Recording Operation Executed by Printer 100)

A recording operation executed by the printer 100 of the embodiment according to the present invention will be described. As described, the printer 100 can execute the single-side recording and the double-side recording for the recording medium.

(Single-Side Recording)

A recording operation according to the single-side recording will be described as a recording operation executed by the printer 100. FIG. 4 to FIG. 7 are explanatory diagrams each of the recording operation according to the single-side recording of the recording operations executed by the printer 100 of the embodiment according to the present invention.

For the single-side recording, the printer 100 first receives a single-side recording instruction from an external apparatus. The printer 100 having the single-side recording instruction received therein positions the first flap 220 at the front side recording position. The printer 100 also positions the second flap 223 at the position to open the first conveyance path 205 and close the third conveyance path 222.

Figure 4:
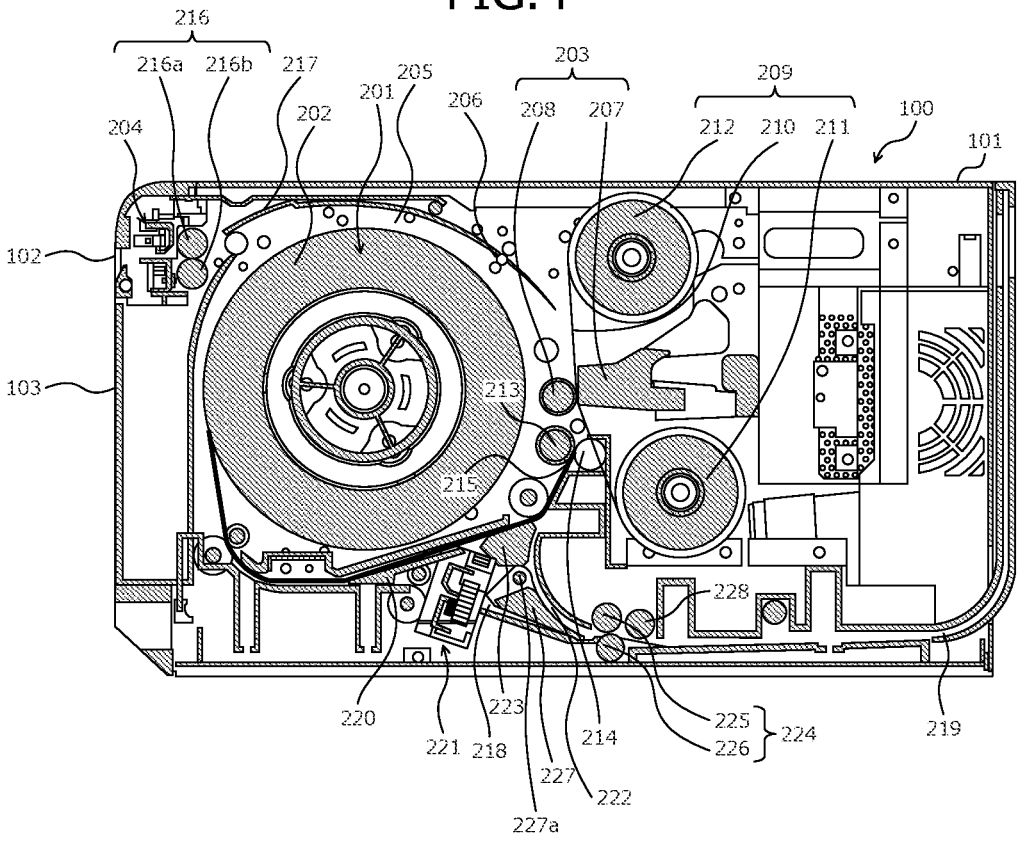
FIG. 4 is an explanatory diagram (part 1) of a recording operation according to a single-side recording of recording operations executed by the printer 100 of the embodiment according to the present invention.
Figure 5:
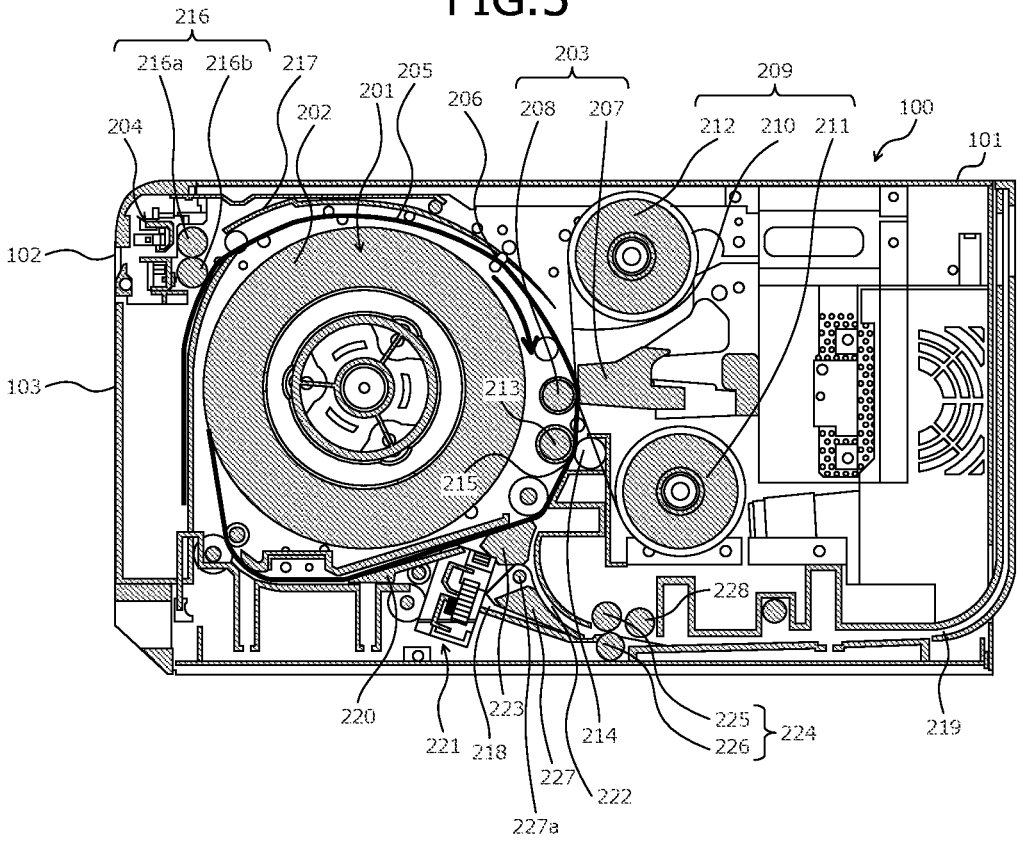
FIG. 5 is an explanatory diagram (part 2) of the recording operation according to the single-side recording of the recording operations executed by the printer 100 of the embodiment according to the present invention.
Figure 6:
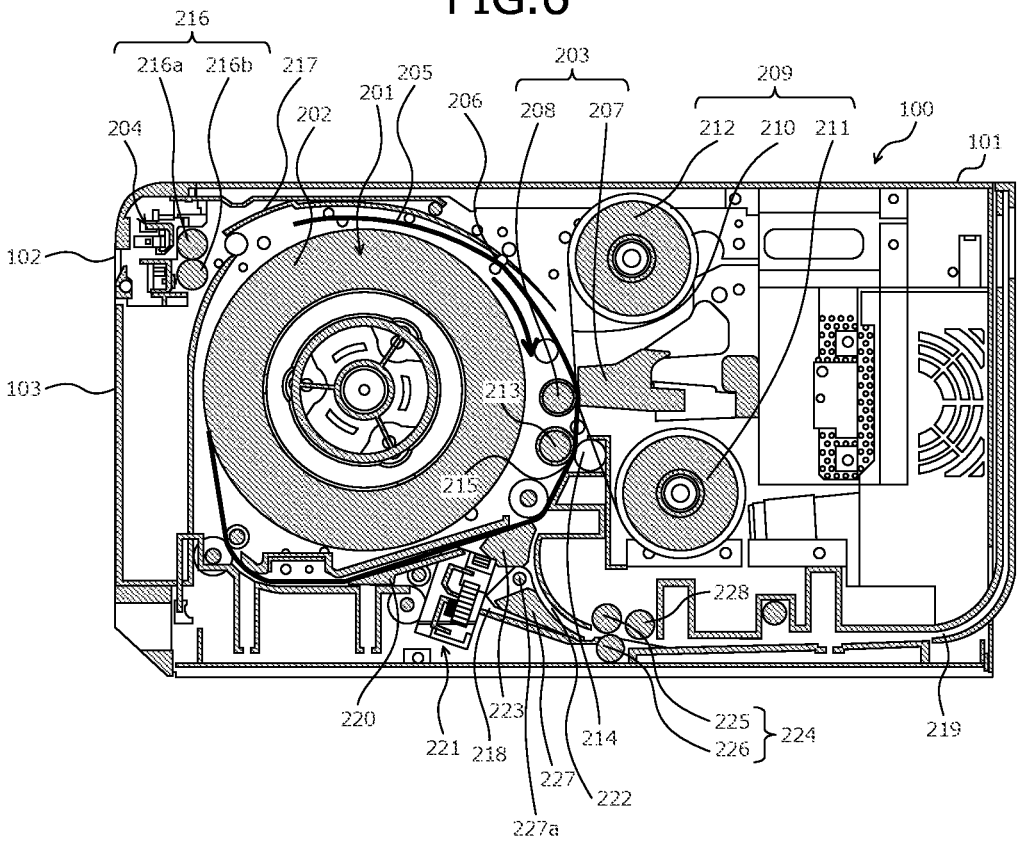
FIG. 6 is an explanatory diagram (part 3) of the recording operation according to the single-side recording of the recording operations executed by the printer 100 of the embodiment according to the present invention.

The shaft of the recording medium is rotated in the recording medium holding unit 201 to pull out the recording medium held by the recording medium holding unit 201 to the first conveyance path 205 (see FIG. 4). The printer 100 can detect that the front end position of the recording medium pulled out from the recording medium holding unit 201 to the first conveyance path 205 reaches the nipping portion 215, based on the output value of the recording medium detection sensor.

The printer 100 rotates the gripping roller 213 and the platen 208 in addition to the conveyance roller 206 in the forward rotation direction, based on the detected front end position of the recording medium. When the long strip-like recording medium is pulled out from the recording medium holding unit 201, the printer 100 causes the thermal head 207 to be separated from the platen 208. The conveyance roller 206 and the gripping roller 213 are rotated in the forward rotation direction until the front end position of the recording medium whose front end position is detected reaches the start position set in advance of the recording operation (a recording start position) (see FIG. 5).

The start position of the recording operation (the recording start position) can be set at the position at which the length from the front end of the recording medium pulled out to the first conveyance path 205 to the recording position of the recording unit 203 is longer than a dimension of the recording medium identified based on the single-side recording instruction received from the external apparatus. For example, the recording start position can be set in the first conveyance path 205. For example, when the recording start position cannot be disposed in the first conveyance path 205, a branch path is disposed that branches from the first conveyance path 205 in the housing 101 and before the recording medium pulled out from the recording medium holding unit 201 reaches the gripping roller 216, and the recording start position can be set in this branch path.

The thermal head 207 is moved to the side of the platen 208 so that the recording medium and the ink ribbon 210 are held being sandwiched by the thermal head 207 and the platen 208. In this state, the heat-generating elements included in the thermal head 207 are selectively heated based on the single-side recording instruction (see FIG. 6) while the long strip-like recording medium pulled out from the recording medium holding unit 201 is conveyed to the first conveyance path 205 in the direction to draw the recording medium into the recording medium holding unit 201 (the direction indicated by an arrow in FIG. 6). As a result, the heat generated by the heat-generating elements included in the thermal head 207 is transmitted to the ink ribbon 210, and the sublimation dye ink disposed on the ink ribbon 210 is sublimation-transferred to the recording medium, whereby the recording operation can be executed for the recording medium.

In this recording operation, the printing is executed sequentially for the Y, M, and C faces for each of the colors of the ink layers. For example, a recording operation for the first color (for example, yellow (Y)) is executed, a recording operation for the second color (for example, magenta (M)) is executed next, and a recording operation for the third color (cyan (C)) is executed. Every time the printer 100 executes the recording operation for each of the colors, the printer 100 pulls out the recording medium to the first conveyance path 205 until the front end of the recording medium drawn into the recording medium holding unit 201 due to the recording operation again reaches the recording start position.

For example, after executing the recording operation for the first color (for example, yellow (Y)), the printer 100 pulls out the recording medium to the first conveyance path 205 until the front end of the recording medium reaches the recording start position. The printer 100 executes the recording operation for the second color (for example, magenta (M)) and, after executing the recording operation for the second color (for example, magenta (M)), the printer 100 pulls out the recording medium to the first conveyance path 205 until the front end of the recording medium reaches the recording start position. The printer 100 similarly executes the recording operation for the third color (cyan (C)).

After executing the recording operations for all the colors for the one side of the recording medium, the printer 100 disposes the overcoat layer on the recording face for which the recording operations are executed. In a state where the recording medium for which the recording operations are executed is pulled out to the first conveyance path 205 until the front end of the recording medium reaches the recording start position, the printer 100 executes the above recording operations and thereby disposes the overcoat layer on the recording face for which the recording operations are executed. The overcoat layer is disposed on the overall recording face for which the recording operations are executed.

The printer 100 drives and controls the corresponding motor driver 304 and thereby conveys the recording medium whose one side has the overcoat layer disposed thereon (hereinafter, properly referred to "recording medium for which the single-side recording is executed") to the side of the discharge outlet 102. The recording medium for which the single-side recording is executed is conveyed until the front end thereof passes through the position for the cutting by the first cutter mechanism 204 and is pulled out to a predetermined position.

For example, the recording medium is conveyed until the border between a non-recorded portion and the recorded portion toward the front end of the recording medium for which the single-side recording is executed reaches the position for the cutting by the first cutter mechanism 204. The position of the recording medium can be detected based on the output value of the front end detecting sensor that is disposed near the gripping roller pair 216.

Figure 7:
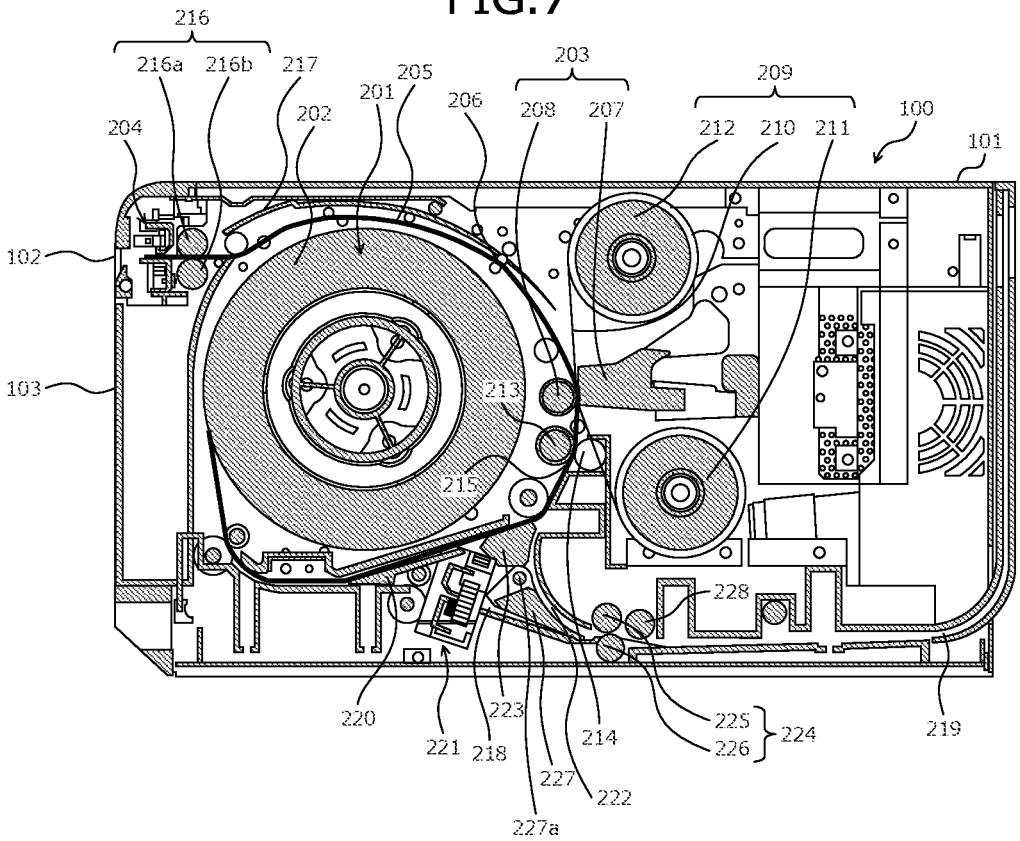
FIG. 7 is an explanatory diagram (part 4) of the recording operation according to the single-side recording of the recording operations executed by the printer 100 of the embodiment according to the present invention.
Figure 8:
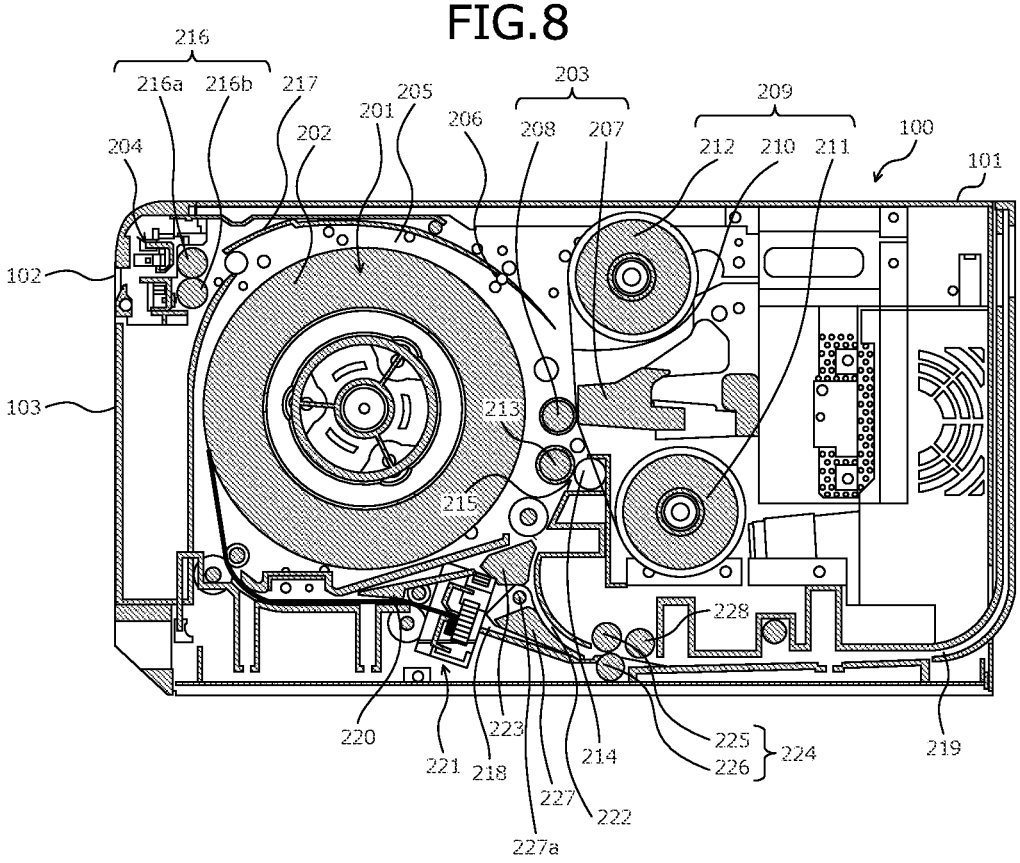
FIG. 8 is an explanatory diagram (part 1) of a recording operation according to a double-side recording of the recording operations executed by the printer 100 of the embodiment according to the present invention.

In a state where the border between the non-recorded portion and the recorded portion toward the front end of the recording medium for which the single-side recording is executed is positioned at the position for the cutting by the first cutter mechanism 204, the printer 100 drives and controls the motor driver 304 of the movable blade motor in the first cutter mechanism 204 to operate the movable blade (see FIG. 7). The margin spanning from the border between the non-recorded portion toward the front end and the recorded portion to the front end of the recording medium for which the single-side recording is executed is cut off from the recorded article. The margin piece produced by this cutting is accommodated in the cutting waste collecting box 103.

The recording medium for which the single-side recording is executed and whose margin at the front end is cut off is conveyed toward the discharge outlet 102. As to the recording medium for which the single-side recording is executed, the printer 100 drives and controls the corresponding motor driver 304 until the recorded portion of the recording medium passes through the position for the cutting by the first cutter mechanism 204 and is conveyed to a predetermined position. For example, the printer 100 conveys the recording medium until the border between the non-recorded portion and the recorded portion on the recording medium holding unit 201 side of the recording medium for which the single-side recording is executed reaches the position for the cutting by the first cutter mechanism 204.

In a state where the border between the non-recorded portion and the recorded portion on the recording medium holding unit 201 side of the recording medium for which the single-side recording is executed is positioned at the position for the cutting by the first cutter mechanism 204, the printer 100 drives and controls the motor driver 304 of the movable blade motor in the first cutter mechanism 204 to operate the movable blade. The border between the non-recorded portion and the recorded portion on the recording medium holding unit 201 side of the recording medium for which the single-side recording is executed is thereby cut and a back end of the recorded article is formed.

In this manner, a recorded article having no margin (a recorded article having no frame) can be provided by cutting both ends of the recorded part 203 of the recording medium for which the single-side recording is executed. The recording medium whose margins at both ends are cut off becomes a single sheet-like recording medium from the long strip-like recording medium. The printer 100 discharges the single sheet-like recording medium from the discharge outlet 102 to the exterior of the printer 100.

For each of the recording operations by the recording unit 203, the energy applied to the recording face of the recording medium during the recording operation (printing energy) can be adjusted by adjusting the amount of energization for the heat-generating elements included in the thermal head 207 (the energization time period), the conveyance velocity of the recording medium for the recording operation (the printing energy), and the like. The winding curl left in the recording medium can thereby be removed and a non-curved and flat recording medium can be obtained by using the long, wound, strip-like recording medium.

(Double-Side Recording)

The recording operation according to the double-side recording will be described as the recording operation executed by the printer 100. FIGS. 8 to 12 are explanatory diagrams each of the recording operation according to the double-side recording of the recording operations executed by the printer 100 of the embodiment according to the present invention.

For the double-side recording, the printer 100 first receives a double-side recording instruction from an external apparatus. The printer 100 having received the double-side recording instruction, positions the first flap 220 at the front side recording position and positions the second flap 223 at the position to open the first conveyance path 205 and close the third conveyance path 222 and, in this state, executes the recording operation for the one side of the recording medium held by the recording medium holding unit 201 similarly to the above single-side recording.

The printer 100 draws the long strip-like recording medium into the recording medium holding unit 201 until the front end of the recording medium for which the single-side recording is executed is positioned on the side closer to the recording medium holding unit 201 than the first flap 220. The printer 100 positions the first flap 220 at the inversion position and thereafter conveys the recording medium held by the recording medium holding unit 201 to the second conveyance path 218 starting with the front end thereof (see FIG. 8).

The printer 100 drives and controls the corresponding motor driver 304 until the front end of the recording medium whose one side has the recording operation executed therefor and that is conveyed to the second conveyance path 218 passes by the second cutter mechanism 221 and is conveyed to a predetermined position. For example, the printer 100 conveys the recording medium until the border between the non-recorded portion and the recorded portion on the recording medium holding unit 201 side of the recording medium for which the single-side recording is executed is conveyed for a predetermined length after passing through the position for the cutting by the second cutter mechanism 221. The position of the front end of the recording medium after passing by the second cutter mechanism 221 can be detected based on, for example, the output value of the front end detecting sensor that is disposed near the second cutter mechanism 221.

The recording medium conveyed to the second conveyance path 218 swings the third flap 227 by abutting of the front end thereof against the third flap 227 when the front end passes through the drawing position. The third flap 227 is urged by the front end of the recording medium conveyed to the second conveyance path 218, rotates around the fulcrum 227*a*, and thereby is positioned at the inversion start position. The recording medium for which the single-side recording is executed is thereby conveyed to the inversion path 219 starting with the front end thereof through the second conveyance path 218 (see FIG. 9).

Figure 9:
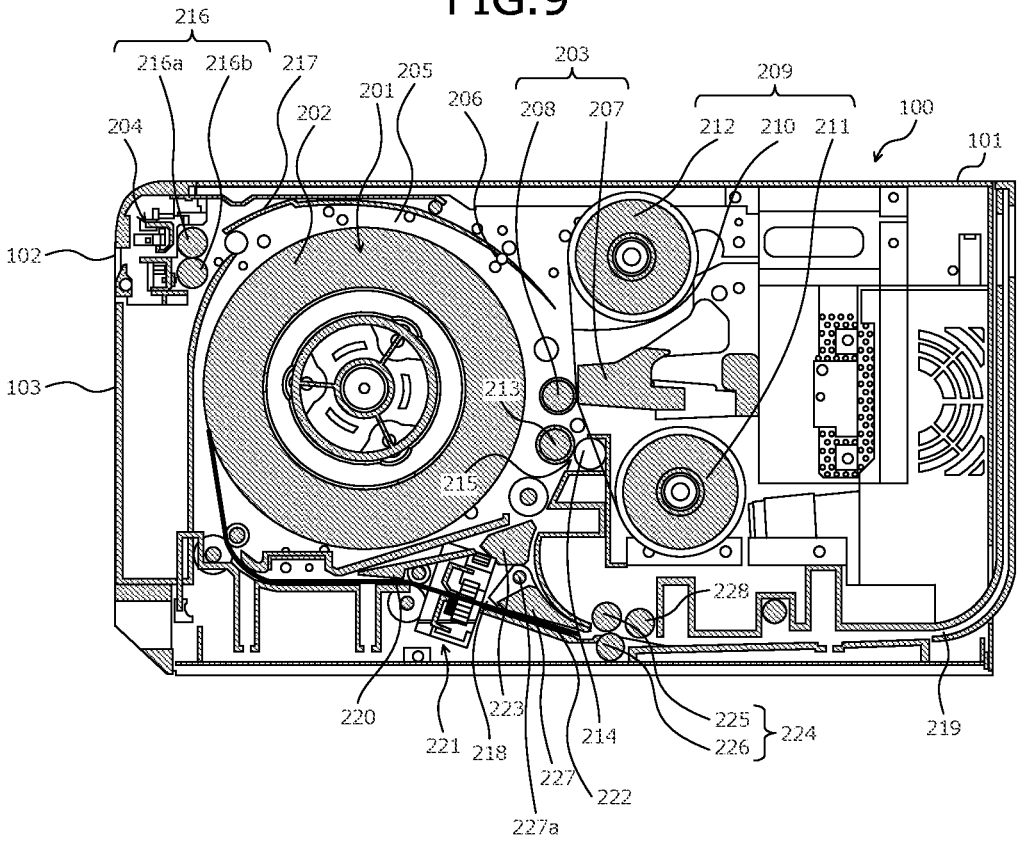
FIG. 9 is an explanatory diagram (part 2) of the recording operation according to the double-side recording of the recording operations executed by the printer 100 of the embodiment according to the present invention.
Figure 10:
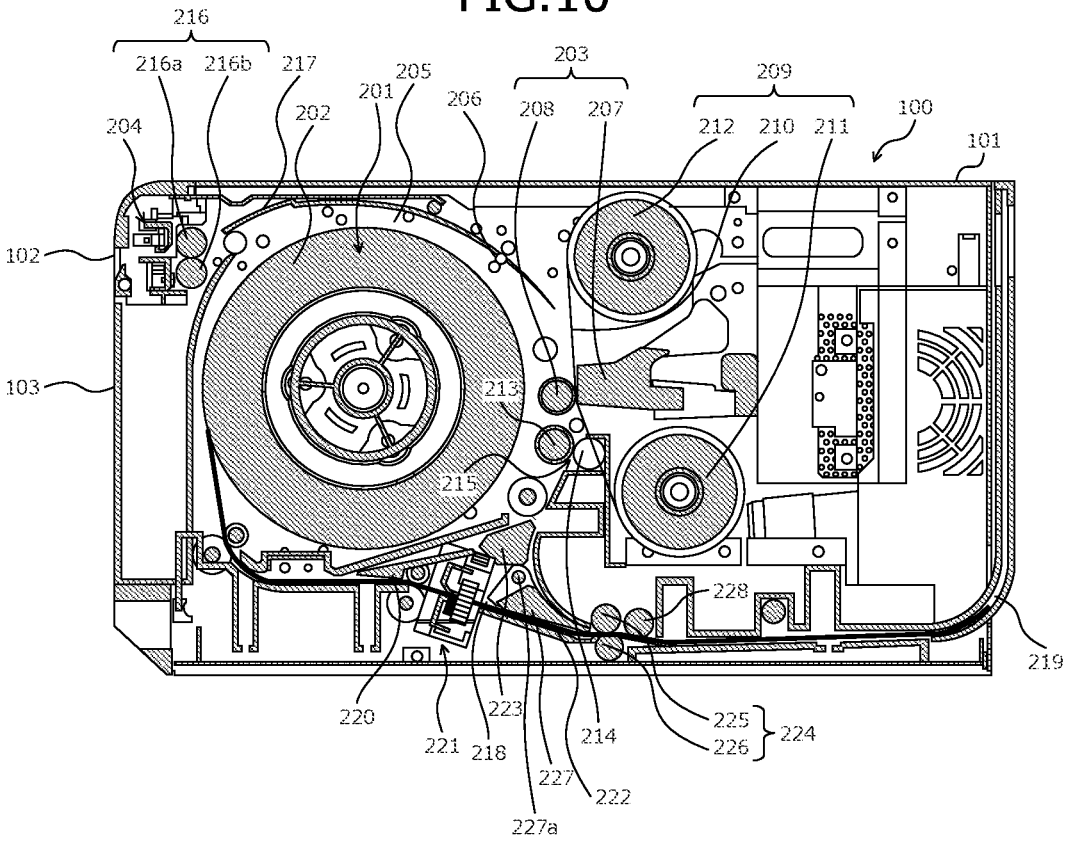
FIG. 10 is an explanatory diagram (part 3) of the recording operation according to the double-side recording of the recording operations executed by the printer 100 of the embodiment according to the present invention.

At this time, the printer 100 drives and controls the corresponding motor driver 304 to rotate the one inversion roller 225 of the inversion roller pair 224 in the counter-clockwise direction (the drawing direction) in FIG. 9 until the back end of the recording medium for which the single-side recording is executed passes through the connection position (the branching position) of the inversion path 219, the second conveyance path 218, and the third conveyance path 222. The recording medium for which the single-side recording is executed is thereby completely drawn in the inversion path 219 starting with the front end thereof. The recording medium (the recording medium for which the single-side recording is executed) being completely drawn in the inversion path 219 starting with the front end thereof has the end portion on the back end side held and sandwiched by the inversion roller pair 224.

In a state where the border between the non-recorded portion and the recorded portion on the recording medium holding unit 201 side of the recording medium for which the single-side recording is executed is conveyed for a predetermined length after passing through the position for the cutting by the second cutter mechanism 221, the printer 100 drives and controls the motor driver 304 of the movable blade motor in the second cutter mechanism 221 to operate the movable blade. The recording medium for which the single-side recording is executed is thereby cut in a state where a margin is disposed on the side of the recording medium toward the recording medium holding unit 201, whereby the back end of the recorded article is formed. A single sheet-like recording medium is formed from the long strip-like recording medium (see FIG. 10).

The single sheet-like recording medium in this state includes a margin on the side more outward than the border between the non-recorded portion and the recorded portion. The margins on the front end side and the back end side are disposed such that, when the one end of the recording medium for which the single-side recording is executed is positioned at the recording start position, the recording medium has a length such that the other end of the recording medium can be held and sandwiched in the nipping portion 215.

Figure 11:
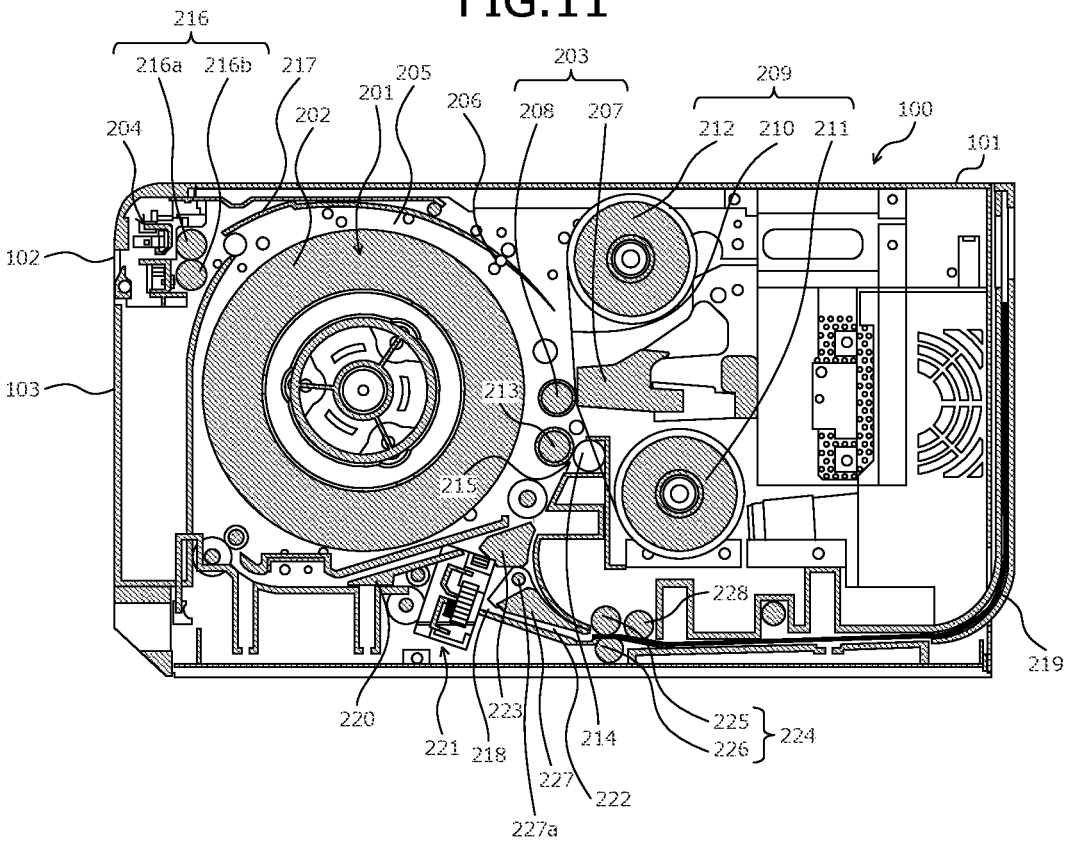
FIG. 11 is an explanatory diagram (part 4) of the recording operation according to the double-side recording of the recording operations executed by the printer 100 of the embodiment according to the present invention.
Figure 12:
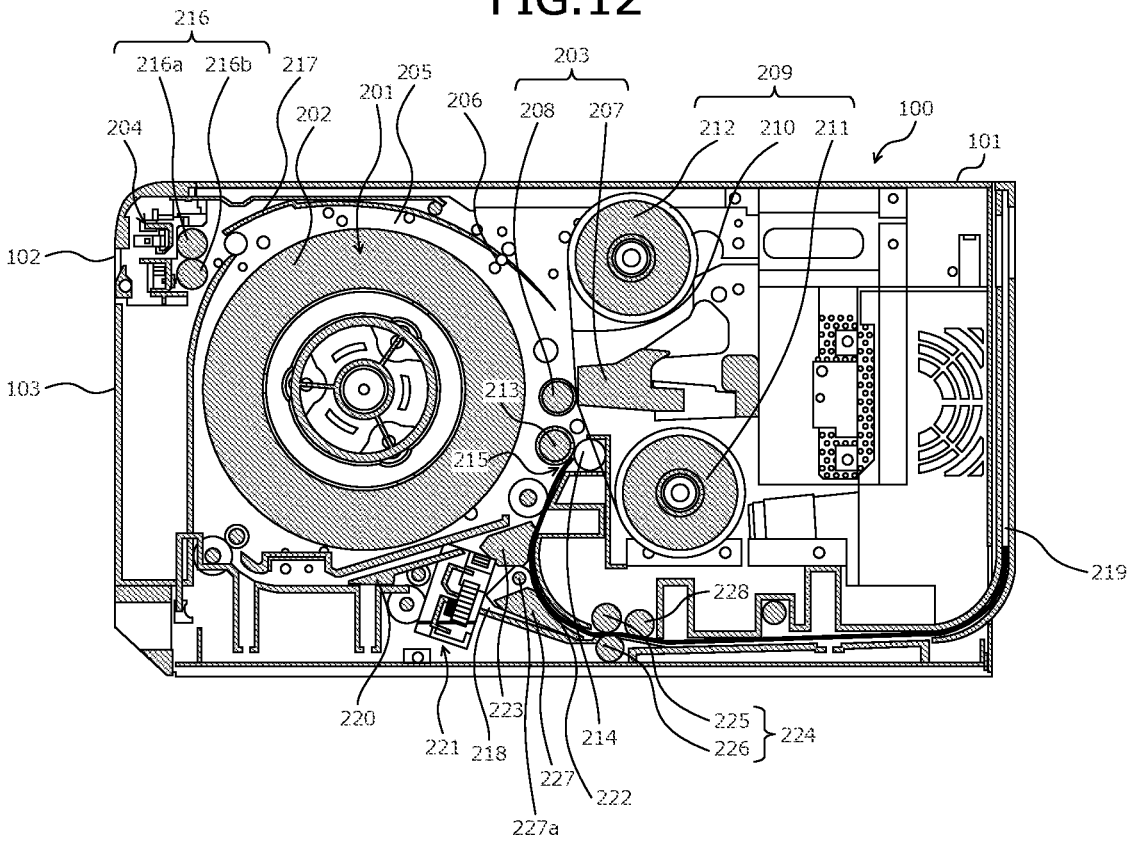
FIG. 12 is an explanatory diagram (part 5) of the recording operation according to the double-side recording of the recording operations executed by the printer 100 of the embodiment according to the present invention.

When the recording medium for which the single-side recording is executed is completely drawn in the inversion path 219, the urging of the third flap 227 by the recording medium conveyed from the second conveyance path 218 to the inversion path 218 is released and the third flap 227 is swung around the fulcrum 227*a* by the urging force of the urging member to be positioned at the inversion start position (see FIG. 11). At this time, the shaft of the recording medium is rotated in the recording medium holding unit 201 to draw the long strip-like recording medium into the recording medium holding unit 201 until the front end of the recording medium is positioned on the side closer to the recording medium holding unit 201 than the first flap 220. The printer 100 also positions the first flap 220 at the front side recording position, whereby the next recording operation is enabled.

In a state where the printer 100 positions the second flap 223 at the position to close the first conveyance path 205 and open the third conveyance path 222 and positions the third flap 227 at the back side recording position, the printer 100 rotates the one inversion roller 225 of the inversion roller pair 224 in the clockwise direction (the backward direction) in FIG. 11. The recording medium for which the single-side recording is executed and that is drawn in the inversion path 219 starting with the front end thereof has the end portion that is the back end when the recording medium is drawn into the inversion path 219 acting as a new front end, and is conveyed to the third conveyance path 222 starting with the new front end thereof (see FIG. 12).

The recording medium drawn in the inversion path 219 is guided by the third flap 227 to be conveyed to the third conveyance path 222 starting with the new front end thereof. The front side and the back side of the recording medium can thereby be inverted relative to the position for the recording by the recording unit 203. At this time, the printer 100 positions the second flap 223 at the position to close the first conveyance path 205 and opens the third conveyance path 222.

The one inversion roller 225 of the inversion roller pair 224 is rotated in the backward rotation direction until the new front end (the back end of the recording medium before the inversion) of the inverted recording medium reaches the nipping portion 215. The one inversion roller 225 is thereafter further rotated in the backward rotation direction, and the gripping roller 213 and the platen 208 are rotated in the forward rotation direction until the new front end position of the inverted recording medium reaches the recording start position based on the detected position of the front end. The thermal head 207 is separated from the platen 208 until the new front end of the inverted recording medium reaches the recording start position.

After conveying the inverted recording medium to the recording start position, the printer 100 moves the thermal head 207 to the side of the platen 208 so that the thermal head 207 and the platen 208 hold and sandwich therebetween the recording medium and the ink ribbon 210. In this state, the printer 100 causes the heat-generating elements included in the thermal head 207 to selectively generate heat based on a back side recording instruction and conveys the inverted recording medium in the direction to draw the recording medium into the inversion path 219.

The heat generated by the heat-generating elements included in the thermal head 207 is transmitted to the ink ribbon 210 and the sublimation dye ink disposed on the ink ribbon 210 is sublimation-transferred to the recording medium, thereby enabling the recording operation to be performed for the recording medium. In the recording operation for the inverted recording medium, that is, the recording operation for the back side of the recording medium, printing is executed sequentially for the Y, M, and C faces for each of the colors of the ink layers similarly to the recording operation for the front face of the recording medium. After the execution of the recording operations for all the colors for the back side of the recording medium, an overcoat layer is disposed on the recording face of the inverted recording medium (the back side) similarly to the recording operation for the front side thereof. The overcoat layer is disposed on the overall face of the recording face for which the recording operation is executed (the back side).

The printer 100 drives and controls the corresponding motor driver 304 to convey the recording medium having the overcoat layers disposed on both sides thereof (hereinafter, properly referred to as "recording medium for which the double-side recording is executed") to the side of the discharge outlet 102. The recording medium for which the double-side recording is executed is conveyed to a predetermined position toward the discharge outlet 102 so that the new front end thereof passes through the position for the cutting by the first cutter mechanism 204. For example, the recording medium is conveyed until the border between the non-recorded portion and the recorded portion on the side of the new front end of the recording medium for which the double-side recording is executed reaches the position for the cutting by the first cutter mechanism 204.

In a state where the border between the non-recorded portion on the side of the front end and the recorded portion on the side of the new front end of the recording medium for which the double-side recording is executed is positioned at the position for the cutting by the first cutter mechanism 204, the printer 100 drives and controls the motor driver 304 of the movable blade motor in the first cutter mechanism 204 to operate the movable blade. The margin spanning from the border between the non-recorded portion and the recorded portion on the side of the new front end of the recording medium for which the double-side recording is executed to the new front end is thereby cut off from the recorded article. The margin piece produced by this cutting is accommodated in the cutting waste collecting box 103.

The recording medium whose margin on the side of the new front end thereof is cut off after the execution of the double-side recording is conveyed toward the discharge outlet 102. The printer 100 drives and controls the corresponding motor driver 304 until the recording medium for which the double-side recording is executed is conveyed to a predetermined position after the recorded portion of the recording medium passes through the position for the cutting by the first cutter mechanism 204. For example, the printer 100 conveys the recording medium until the border between the non-recorded portion and the recorded portion on the side of the new back end of the recording medium for which the double-side recording is executed reaches the position for the cutting by the first cutter mechanism 204.

In a state where the printer 100 positions the border between the non-recorded portion and the recorded portion on the recording medium holding unit 201 side of the recording medium for which the double-side recording is executed, at the position for the cutting by the first cutter mechanism 204, the printer 100 drives and controls the motor driver 304 of the movable blade motor in the first cutter mechanism 204 to operate the movable blade. The border between the non-recorded portion and the recorded portion on the recording medium holding unit 201 side of the recording medium for which the double-side recording is executed is thereby cut. The margin piece produced by this cutting is accommodated in the cutting waste collecting box 103.

A recorded article having no margin (a recorded article having no frame) can be provided by cutting both ends of the recorded part 203 of the recording medium for which the double-side recording is executed as above. The recording medium whose margins at both ends are cut off becomes a single sheet-like recording medium from the long strip-like recording medium. The printer 100 discharges the single sheet-like recording medium from the discharge outlet 102 to the exterior of the printer 100.

As described above, the printer 100 of the embodiment according to the present invention includes the recording medium holding unit 201 that holds the long strip-like recording medium wound thereon to be able to be pulled out starting with the front end on the outer circumference side, the recording unit 203 that pulls out the recording medium held by the recording medium holding unit 201 to the side higher in the vertical direction than the position for pulling out from the recording medium holding unit 201 and that executes the recording operation for the pulled-out recording medium, and the second cutter mechanism 221 that is disposed beneath the recording medium holding unit 201 in the vertical direction and that cuts the recording medium for which the recording operation is executed by the recording unit 203, at the back end thereof separate from the front end by the predetermined length.

The printer 100 of the embodiment according to the present invention also includes the first flap 220 that is selectively positioned at the front side recording position and the inversion position, and the third flap 227 that is selectively positioned at the inversion start position and the back side recording position. The printer 100 of the embodiment according to the present invention also includes the inversion path 219 and the inversion roller pair 224 that draw the recording medium cut off by the second cutter mechanism 221 into the inversion path 219 starting with the front end thereof and that discharge the recording medium drawn into the inversion path 219, to the exterior of the inversion path 219 starting with the back end (the new front end) thereof.

The printer 100 of the embodiment according to the present invention is characterized in that the drawing position is arranged to be lower than the recording medium holding unit 201 and the recording unit 203 in the vertical direction.

According to the printer 100 of the embodiment of the present invention, in the printer that executes the recording operation for both sides of the recording medium using the single recording unit 203, the inversion path 219 can be arranged using the space produced by arranging the second cutter mechanism 221 that is necessary to invert the front side and the back side from each other relative to the position for the recording, by arranging the drawing position of the inversion path 219 to be lower than the recording medium holding unit 201 and the recording unit 203 in the vertical direction.

It is preferred that the second cutter mechanism 221 be arranged at a position lower than those of the recording medium holding unit 201 and the recording unit 203 in the vertical direction to prevent adhesion of paper powder produced in the cutting to the recording medium. Assuming that the second cutter mechanism 221 is arranged to be higher than the recording medium holding unit 201 and the recording unit 203 in the vertical direction, the second cutter mechanism 221 has to be arranged at a position that does not overlap with those of the recording medium holding unit 201 and the recording unit 203 in the vertical direction to prevent adhesion of the paper powder. The dimensions of the printer in the horizontal direction are therefore increased and the size of the printer is thereby increased.

In contrast, in the printer 100 of the embodiment according to the present invention, increases in the size of the printer caused by arranging the second cutter mechanism 221 necessary for executing the double-side recording using the single recording unit 203 can be suppressed by arranging the inversion path 219 using the space beneath the recording medium holding unit 201 and the recording unit 203 to arrange the second cutter mechanism 221. Reduction in the size of the printer can thereby be facilitated.

The printer 100 of the embodiment according to the present invention is characterized in that the inversion path 219 is arranged on the side opposite the recording medium holding unit 201 sandwiching the recording unit 203 therebetween in the horizontal direction for the recording medium for which the recording operation is executed by the recording unit 203.

According to the printer 100 of the embodiment of the present invention, the recording medium pulled out from the recording medium holding unit 201 can be drawn into the inversion path 219 without being abruptly bent or curved. Reductions in the size of the printer can thereby be facilitated without damaging the recording medium.

The printer 100 of the embodiment according to the present invention is characterized in that the inversion path 219 is arranged to surround the recording unit 203 from the side opposite the recording medium holding unit 201.

According to the printer 100 of the embodiment according to the present invention, the recording medium pulled out from the recording medium holding unit 201 can be drawn into the inversion path 219 without being abruptly bent or curved, and the space necessary for arranging the inversion path 219 can be suppressed. Reductions in the size of the printer can thereby be facilitated without damaging the recording medium.

The printer 100 of the embodiment according to the present invention may include an urging unit that urges the third flap 227 to position the third flap 227 at the back side recording position. In this case, the urging unit positions the third flap 227 at the inversion start position when the urging unit is urged by the recording medium conveyed to the drawing position.

According to the printer 100 of the embodiment according to the present invention, only when the recording medium is conveyed to the inversion path 219 by positioning the third flap 227 at the inversion start position by urging the third flap 227 using the recording medium conveyed to the drawing position, that is, only in the case where the double-side recording is executed, the third flap 227 can be positioned at the inversion start position. The position of the third flap 227 can thereby be switched without disposing any complicated mechanism and the configuration can therefore be simplified. This can contribute to reductions in the size of the printer.

According to the printer 100 of the embodiment according to the present invention, the time when the third flap 227 positioned at the inversion start position is again positioned at the back side recording position is after the recording medium conveyed to the drawing position completely passes by the third flap 227 and, after the recording medium completely passes by the third flap 227, the third flap 227 is positioned at the back side recording position by the urging force of the urging member. The recording medium discharged to the exterior of the inversion path 219 starting with the back end thereof can reliably be conveyed to the position for the recording.

INDUSTRIAL APPLICABILITY

As above, the printer according to the present invention is useful for a printer capable of executing recording to both sides of the recording medium, and is especially suitable for a printer that executes recording to both sides of a long strip-like recording medium using the recording medium.

EXPLANATIONS OF LETTERS OR NUMERALS

100 printer
101 housing
102 discharge outlet
201 recording medium holding unit
203 recording unit
204 first cutter mechanism
205 first conveyance path
207 thermal head
208 platen
209 ribbon unit
210 ink ribbon
213 gripping roller
214 pinch roller
216 gripping roller pair
218 second conveyance path
219 inversion path
221 second cutter mechanism
222 third conveyance path
223 second flap
224 inversion roller pair
225, 226 inversion rollers
227 third flap

The invention claimed is:

1. A printer comprising:

a recording medium holding unit that holds a long, wound, strip-like recording medium so as to enable the recording medium to be pulled out starting with a front end on an outer circumference side thereof;

a recording unit that pulls out the recording medium held by the recording medium holding unit to a position higher in a vertical direction than a position for pulling out from the recording medium holding unit, the recording unit performing a recording operation for the recording medium that is pulled out;

a cutting unit that is disposed beneath the recording medium holding unit in the vertical direction, the cutting unit cutting the recording medium at a back end of the recording medium for which the recording operation is executed by the recording unit, the back end being separated from the front end by a predetermined length;

a first switching unit that includes a first switching member selectively positioned at a front side recording position connecting a position for recording by the recording unit and the position for pulling out, and at an inversion position connecting a position for cutting by the cutting unit and the position for pulling out, the first switching unit positioning the first switching member at the front side recording position or the inversion position;

an inverting unit that includes an inversion path that draws in from the front end, the recording medium cut off by the cutting unit, the inverting unit discharging the recording medium drawn into the inversion path to an exterior of the inversion path starting with the back end thereof; and a second switching unit that includes a second switching member selectively positioned at an inversion start position connecting a drawing position to draw the recording medium into the inversion path and the position for the cutting, and at the back side recording position connecting the drawing position and the recording position, the second switching unit positioning the second switching member at the inversion start position or the back side recording position, wherein the first switching unit and the second switching unit are different units, and wherein the drawing position is arranged to be lower than the recording medium holding unit and the recording unit in the vertical direction.

2. The printer according to claim 1, wherein the inversion path is arranged on a side opposite the recording medium holding unit, sandwiching the recording unit therebetween in a horizontal direction for the recording medium for which the recording operation is executed by the recording unit.

3. The printer according to claim 2, wherein the inversion path is arranged to surround the recording unit from a side opposite the recording medium holding unit.

4. The printer according to claim 1, wherein the second switching unit includes an urging unit that urges the second switching member to position the second switching member at the back side recording position, and the urging unit positions the second switching unit at the inversion start position when the second switching unit is urged by the recording medium conveyed to the drawing position.

* * * * *